US010214016B2

(12) United States Patent
Shimada et al.

(10) Patent No.: US 10,214,016 B2
(45) Date of Patent: Feb. 26, 2019

(54) INKJET PRINTING APPARATUS

(71) Applicant: CANON KABUSHIKI KAISHA, Tokyo (JP)

(72) Inventors: Koki Shimada, Kawasaki (JP); Yusuke Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/881,562

(22) Filed: Jan. 26, 2018

(65) Prior Publication Data

US 2018/0215156 A1 Aug. 2, 2018

(30) Foreign Application Priority Data

Jan. 31, 2017 (JP) ..... 2017-016208

(51) Int. Cl.
*B41J 2/165* (2006.01)
*B41J 2/185* (2006.01)

(52) U.S. Cl.
CPC ..... *B41J 2/16511* (2013.01); *B41J 2/16505* (2013.01); *B41J 2/16508* (2013.01); *B41J 2/16517* (2013.01); *B41J 2/16523* (2013.01); *B41J 2/16532* (2013.01); *B41J 2/16535* (2013.01); *B41J 2/16538* (2013.01); *B41J 2/16544* (2013.01); *B41J 2/185* (2013.01); *B41J 2002/16594* (2013.01); *B41J 2002/16597* (2013.01)

(58) Field of Classification Search
CPC .... B41J 2/165; B41J 2/16505; B41J 2/16508; B41J 2/16511; B41J 2/16523; B41J 2/16535; B41J 2/16538; B41J 2/16547; B41J 2002/16594; B41J 2002/16597
See application file for complete search history.

(56) References Cited

U.S. PATENT DOCUMENTS 7,699,432 B2 * 4/2010 Simmons ..... B41J 23/025 347/32
2007/0085875 A1 * 4/2007 Shimazaki ..... B41J 2/16511 347/32

(Continued)

FOREIGN PATENT DOCUMENTS

JP 2007-160616 A 6/2007
JP 2013-49202 A 3/2013
JP 2016-140978 A 8/2016

*Primary Examiner* — Anh T. N. Vo
(74) *Attorney, Agent, or Firm* — Canon U.S.A., Inc., IP Division

(57) ABSTRACT

An inkjet printing apparatus includes a printhead having an ejection orifice surface on which ejection orifices for ejecting ink are arranged, where the printhead performs a printing operation in a printing area; a carriage including the printhead, and movable in a first direction; a cap for covering the ejection orifice surface; and a wiper that wipes the ejection orifice surface. The cap is movable, by a movement of the carriage, to a first position, and to a second position farther from the printing area along the first direction. At the second position, the cap can rise and lower to a capping position at which the cap abuts the ejection orifice surface, and to a separated position at which the cap does not abut the ejection orifice surface. The wiper wipes the ejection orifice surface when the cap is at the second position and at the separated position.

20 Claims, 7 Drawing Sheets

(56) References Cited

U.S. PATENT DOCUMENTS

| | | | | |
|---|---|---|---|---|
| 2012/0147090 | A1* | 6/2012 | Sato | B41J 2/16547 347/32 |
| 2014/0210907 | A1* | 7/2014 | Miyazawa | B41J 2/16544 347/30 |
| 2016/0067972 | A1* | 3/2016 | Tanjo | B41J 2/16508 347/32 |

* cited by examiner

INKJET PRINTING APPARATUS

BACKGROUND OF THE INVENTION

Field of the Invention

The present disclosure relates to an inkjet printing apparatus including a maintenance unit for recovering a printhead.

Description of the Related Art

The printing apparatus disclosed in Japanese Patent Laid-Open No. 2007-160616 includes a cleaning device having a cap for capping the nozzle outlet surface of the printhead, and a wiper blade for wiping the nozzle outlet surface. To maintain high ejection performance of the printhead, the cleaning device activates a negative pressure generator to suck up ink while the nozzle outlet surface is capped. The cleaning device then wipes the nozzle outlet surface using the wiper blade to wipe off the ink adhered on the nozzle outlet surface during the suction of the ink.

However, the inkjet printing apparatus disclosed in Japanese Patent Laid-Open No. 2007-160616 may be disadvantageous in that, after the suction of the ink at a capping position, the inkjet printing apparatus moves the carriage including the printhead, for the wiping operation, to a wiping position away from the recording medium along the main scanning direction, and thus the carriage may take time to move over the distance between the capping position and the wiping position apart from the capping position with respect to the printhead along the main scanning direction.

SUMMARY OF THE INVENTION

An aspect of the present disclosure provides an inkjet printing apparatus capable of reducing the carriage travel distance in a recovery operation performed on the printhead.

To achieve the above object, in one aspect of the present disclosure, an inkjet printing apparatus includes a printhead having an ejection orifice surface on which a plurality of ejection orifices for ejecting ink are arranged, the printhead configured to perform a printing operation in a printing area, a carriage including the printhead, and movable in a first direction, a cap for covering the ejection orifice surface, and a wiper configured to wipe the ejection orifice surface. The cap is movable, by a movement of the carriage, to a first position, and to a second position farther from the printing area than the first position along the first direction. At the second position along the first direction, the cap can rise and lower to a capping position at which the cap abuts the ejection orifice surface, and to a separated position at which the cap does not abut the ejection orifice surface. The wiper wipes the ejection orifice surface when the cap is at the second position and at the separated position.

Further features of the present disclosure will become apparent from the following description of exemplary embodiments (with reference to the attached drawings).

DESCRIPTION OF THE EMBODIMENTS

A printing apparatus according to embodiments of the present disclosure will be described below. Note that the constituent elements of the printing apparatus according to these embodiments are illustrative in nature, and the description of these embodiments is not intended to limit the scope of the present disclosure. As used herein, the term "ink" refers collectively to liquids such as a recording liquid. As used herein, the term "record" and "print" refer not only to recording/printing onto a planar material, but also to recording/printing onto a three-dimensional object. As used herein, the term "recording medium" is an object to which ink is ejected, and refers collectively to recording media including paper, cloth, a plastic film, a metal plate, glass, a ceramic, wood, and leather. Examples of the recording medium also include a rolled continuous sheet as well as a cut sheet.

First Embodiment

Figure 1:
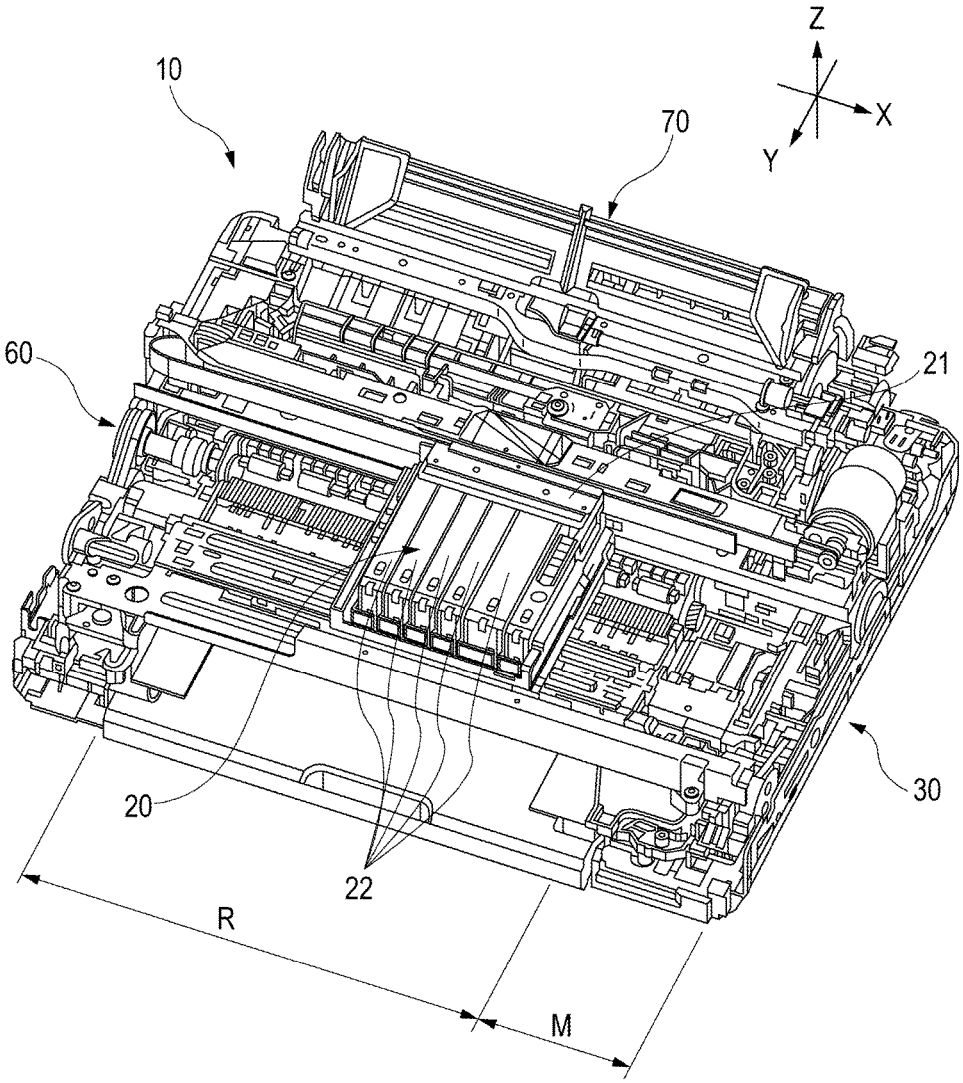
FIG. 1 is an external perspective view of an inkjet printing apparatus according to a first embodiment of the present disclosure.

FIG. 1 is a schematic view of an inkjet printing apparatus (hereinafter referred to as "printing apparatus") 10 according to this embodiment. The printing apparatus 10 includes a printing unit 20, a maintenance unit 30, a sheet feed drive unit 60, and a sheet feeder 70. The sheet feeder 70 feeds loaded recording media one by one into the main body of the printing apparatus 10. The sheet feed drive unit 60 is disposed downstream of the sheet feeder 70 along a Y-direction as illustrated in FIG. 1, and rotates a feed roller (not shown) to feed a recording medium. As used herein, the Y-direction represents the direction in which a recording medium is fed, and therefore, is referred to also as "feed direction."

The printing unit 20 prints an image on a recording medium being fed. The printing unit 20 includes a carriage 21. The carriage 21 carries a plurality of ink reservoirs 22 and a printhead 2 (see FIGS. 5A to 5D), and moves reciprocally along an X-direction perpendicular to the Y-direction. In this embodiment, the X-direction and the Y-direction are perpendicular to each other. As used herein, the X-direction represents the scanning direction of the carriage 21, and therefore, is referred to also as "main scanning direction (first direction)."

The printhead 2 is disposed in a bottom portion of the carriage 21. The printhead 2 has a plurality of ejection orifices through which ink is ejected (see FIGS. 5A to 5D). In moving reciprocally along the main scanning direction, the printhead 2 ejects ink droplets to print a band of the image on the recording medium (printing operation). When a band of the image has been printed on the recording medium, the sheet feed drive unit 60 feeds the recording medium in the feed direction by a predetermined distance (intermittent feed operation). Repeating the printing operation and the intermittent feed operation for a band of the image enables an image to be printed on the entire recording medium. The printhead 2 may be detachable from the carriage 21.

The maintenance unit 30 includes a cap unit 31 and an array of wipers 32 (see FIG. 3), and maintains/recovers high ejection performance of the printhead 2 (recovery operation). The maintenance unit 30 is disposed in a recovery area M. The recovery area M resides outside a printing area R in which a printing operation is performed, and the carriage 21 moves over the recovery area M. In this embodiment, the recovery operation mainly includes a preliminary ejection operation, a wiping operation, and an ink suction operation. The preliminary ejection operation ejects ink from the printhead 2 toward the cap unit 31 so that the ink will not reach the recording medium. The wiping operation wipes, by the wipers 32, the ejection orifice surface 23 (see FIGS. 5A to 5D) on which the ejection orifices of the printhead 2 are arranged. The ink suction operation sucks up ink from the ejection orifices of the printhead 2 using a suction device.

Figure 2:
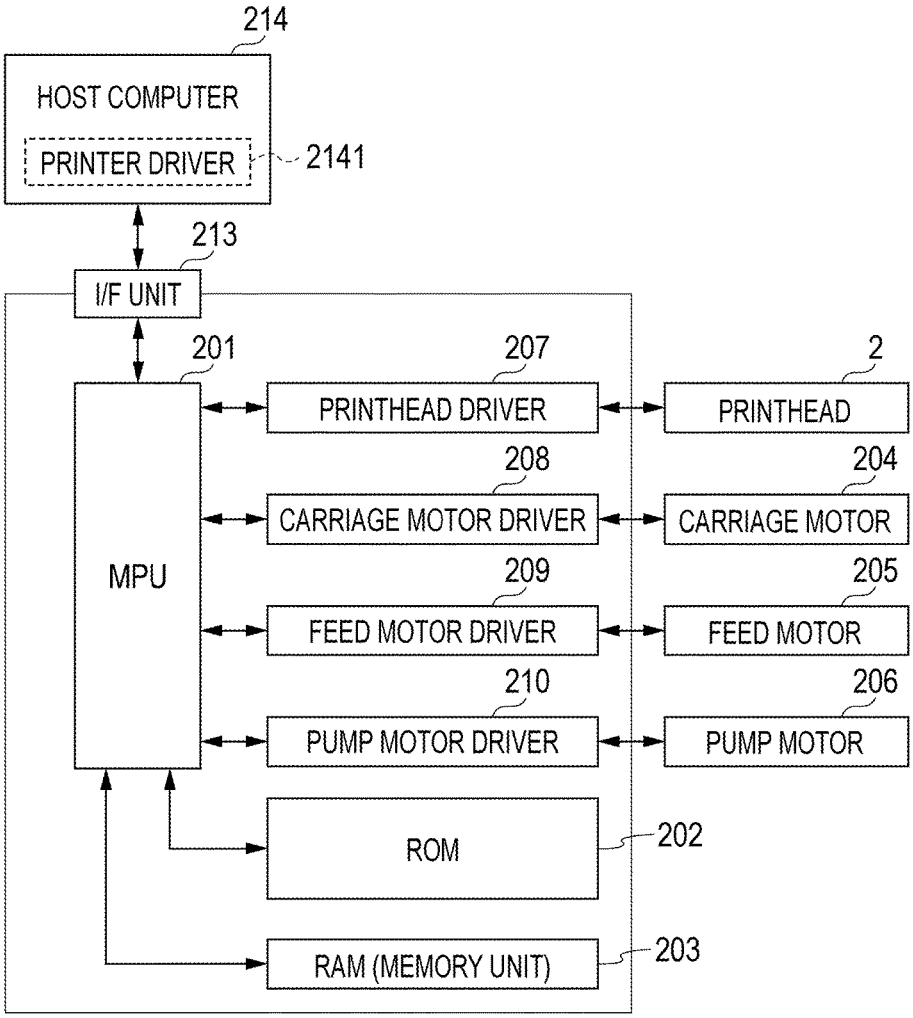
FIG. 2 is a block diagram of a control unit for controlling the inkjet printing apparatus according to the first embodiment.

The sheet feed drive unit 60 includes, for example, a feed motor 205 (see FIG. 2). The sheet feed drive unit 60 is disposed on one end side in the main scanning direction, while the maintenance unit 30 is disposed on the other end side in the main scanning direction. In this embodiment, as illustrated in FIG. 1, the sheet feed drive unit 60 is positioned on the left side of the printing apparatus 10, and the maintenance unit 30 is positioned on the right side of the printing apparatus 10, as viewed from the front side. The elements in the maintenance unit 30 are driven by the sheet feed drive unit 60 via a chain of drives. In the printing operation, the printhead 2 moves from the right side (the maintenance unit 30 side) to the left side (the sheet feed drive unit 60 side), and then returns back to the right side (the maintenance unit 30 side). This reciprocating motion is herein defined as one scan of the carriage 21.

FIG. 2 is a block diagram of a control unit for controlling the printing apparatus 10. The control unit includes a microprocessor unit (MPU) 201, a read only memory (ROM 202), and a random access memory (RAM) 203. The MPU 201 controls the entirety of the printing apparatus 10, including operations of the components and processing of various data. The ROM 202 stores programs executed by the MPU 201 and various data. The RAM 203 temporarily stores data to be processed by the MPU 201, and data received from a host computer 214.

The printhead 2 is controlled by a printhead driver 207. The carriage 21 is driven by a carriage motor 204, which is controlled by a carriage motor driver 208. The feed motor 205 included in the sheet feed drive unit 60 is controlled by a feed motor driver 209. A feed roller included in the sheet feeder 70 and a pump 35 of the maintenance unit 30 (described herein later) are controlled by a pump motor 206. The pump motor 206 is controlled by a pump motor driver 210.

The host computer 214 includes a printer driver 2141 for compiling a printed image and printing information, such as printed image quality, and for communication with the printing apparatus 10 when an instruction is provided by a user to perform a printing operation. The printed image and other information are exchanged between the MPU 201 and the host computer 214 via an interface (I/F) unit 213.

Figure 3:
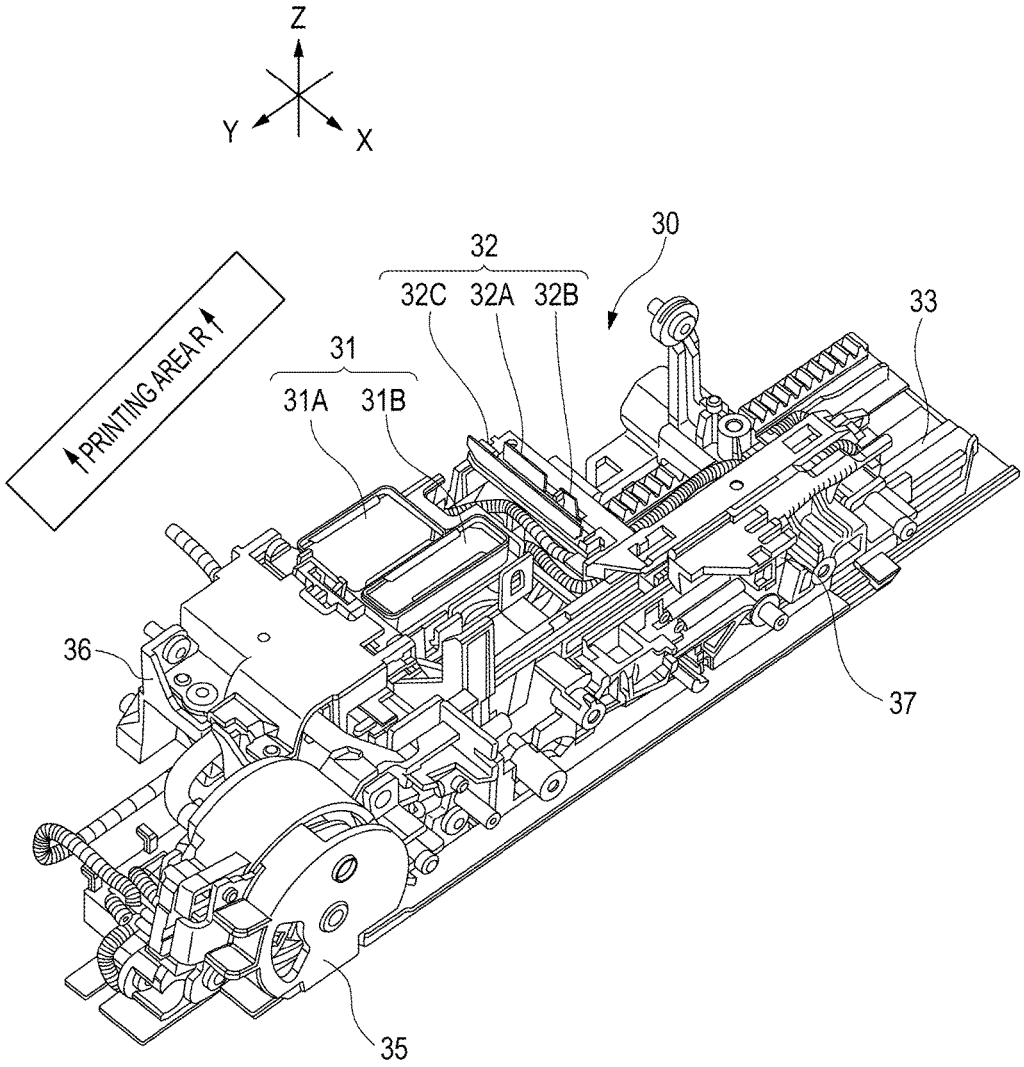
FIG. 3 is a perspective view of a maintenance unit of the inkjet printing apparatus according to the first embodiment.

FIG. 3 is a perspective view of the maintenance unit 30. The maintenance unit 30 includes the cap unit 31, the array of wipers 32, a cam slider (cam member) 33, a pump 35, and an air valve lever 37.

The cap unit 31 is formed of a flexible material. The cap unit 31 covers the ejection orifice surface 23 of the printhead 2 during the ink suction operation and in a standby state of the printing apparatus 10. The cap unit 31 receives the ink ejected in the preliminary ejection operation by the printhead 2. The cap unit 31 is connected to the pump 35. The pump 35 is driven by the pump motor 206 to allow the ink to be sucked up during capping of the ejection orifice surface 23 (ink suction operation). The cap unit 31 and the pump 35 are connected to each other by a cap tube (not shown). The ejection orifice surface 23 of the printhead 2 includes a first ejection orifice surface 23A and a second ejection orifice surface 23B. The first ejection orifice surface 23A has an ejection orifice array for ejecting chromatic color inks of colors such as magenta, cyan, and yellow. The second ejection orifice surface 23B has an ejection orifice array for ejecting black ink (see FIGS. 5A to 5D). The cap unit 31 includes a first cap 31A corresponding to the first ejection orifice surface 23A, and a second cap 31B corresponding to the second ejection orifice surface 23B.

The wipers 32 each have a blade shape. The wipers 32 wipe off ink or other material remaining on the ejection orifice surface 23 and around the ejection orifice arrays of the printhead 2 after the ink suction operation. In this embodiment, the wipers 32 include a first wiper 32A for wiping the first ejection orifice surface 23A, a second wiper 32B for wiping the second ejection orifice surface 23B, and a tab wiper 32C for wiping the entirety of the ejection orifice surface 23.

The air valve lever 37 is connected to the cap unit 31, and switches the state of the inside of the cap unit 31 between states in and out of communication with the atmosphere. More specifically, when the air valve lever 37 abuts an air valve seal (not shown) formed of material such as rubber, the inside of the cap unit 31 is prevented from communicating with the atmosphere, while when the air valve lever 37 does not abut the air valve seal, the inside of the cap unit 31 communicates with the atmosphere. The cap unit 31 and the air valve lever 37 are connected to each other by an air valve tube (not shown).

The cam slider 33 is driven by the sheet feed drive unit 60 to move reciprocally in the feed direction. The reciprocating movement of the cam slider 33 causes a cam surface on the cam slider 33 to abut a cam follower surface of an associated member accordingly, thereby allowing the associated member of the maintenance unit 30 to move individually. In this embodiment, the reciprocating movement of the cam slider 33 causes the cap unit 31, the array of wipers 32, and the air valve lever 37 to move individually. Note that the pump 35 is not driven by the sheet feed drive unit 60, but by the pump motor 206.

Although this embodiment assumes that the cam slider 33 functions as a cam mechanism, the cam mechanism is not limited to a cam mechanism that moves reciprocally, and may also be a rotary cam mechanism. Moreover, the maintenance unit 30 including at least the cap unit 31 and the array of wipers 32 is sufficient to perform the maintenance operation on the printhead 2. Thus, the maintenance unit 30 does not necessarily need to include all the members as described above. That is, the maintenance unit 30 of this embodiment is not limited to a unit including all the members of the maintenance unit 30 described above.

Figure 4:
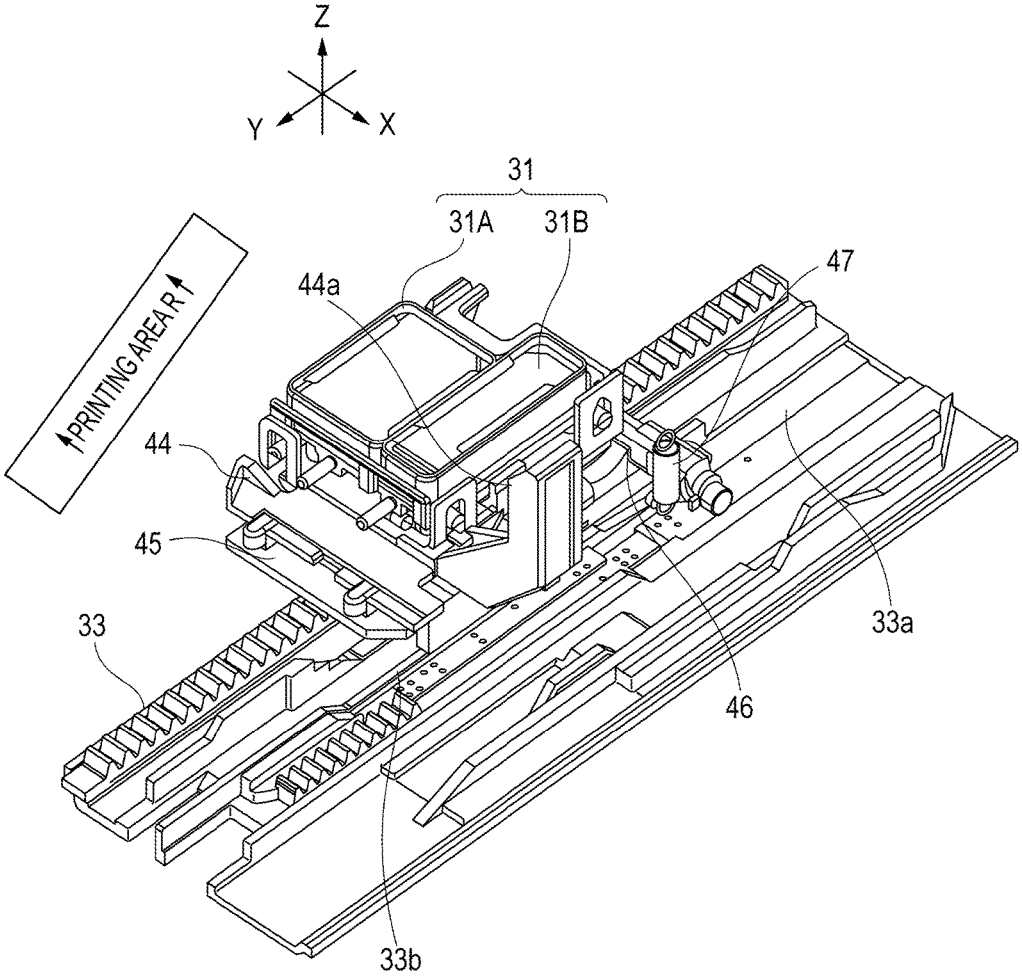
FIG. 4 is a perspective view selectively illustrating members involved in a movement of a cap unit in the maintenance unit of the inkjet printing apparatus according to the first embodiment.

The operation of the maintenance unit 30 will next be described in detail with reference to FIGS. 4 to 6B. FIG. 4 is a perspective view selectively illustrating members involved in the movement of the cap unit 31 in the maintenance unit 30. FIGS. 5A to 5D are each a schematic front view for explaining the sliding movement of the cap unit 31. FIGS. 6A and 6B are each a schematic cross-sectional view in the feed direction for explaining the rising and lowering movement of the cap unit 31.

The cap unit 31 is attached to a cap slider (support member) 44 using four springs 48. FIGS. 5A to 5D each illustrate two of the springs 48, and the other two of the springs 48 are disposed behind the illustrated springs 48. The cap unit 31 is biased upward in the vertical direction (Z-direction or second direction) by the springs 48. In other words, the cap unit 31 is biased toward the ejection orifice surface 23 of the printhead 2. Use of a buffer mechanism, such as the springs 48, capable of providing a fine adjustment in the Z-direction (vertical direction) allows the ejection orifice surface 23 of the printhead 2 and the cap unit 31 to face each other suitably even when the printhead 2 approaches in an unstable position.

The cap slider 44 is attached to the cap base (support member) 45 slidably in the main scanning direction (X-direction). A slider spring 49 is provided between the cap slider 44 and the cap base 45 to bias the cap slider 44 toward the printing area R. As illustrated in FIGS. 5A to 5D, the cap slider 44 has a portion extending upward in the vertical direction, and therefore has an L-shape viewed from the front of the printing apparatus 10. The cap slider 44 includes an abutment portion 44*a* in the portion extending upward in the vertical direction. The abutment portion 44*a* abuts the carriage 21 that has moved from the printing area R into the recovery area M.

Figure 5A:
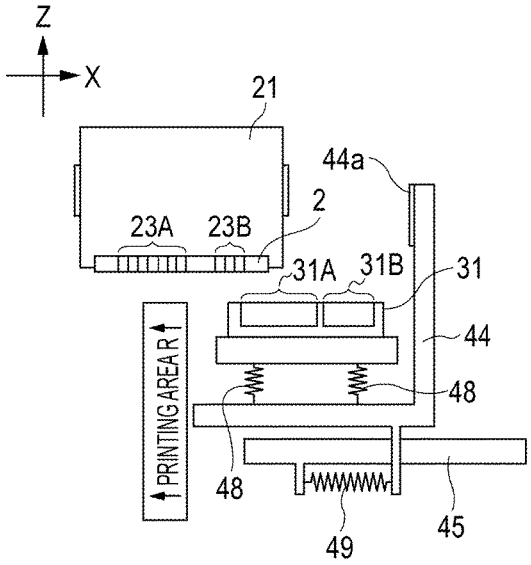
FIGS. 5A to 5D are each a schematic front view for explaining the movement of the cap unit of the inkjet printing apparatus according to the first embodiment.
Figure 6A:
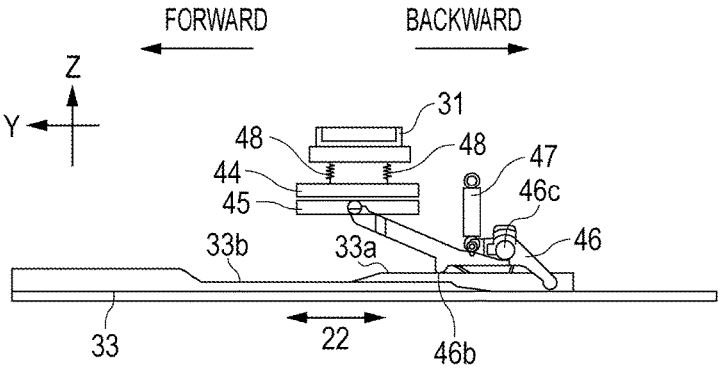
FIGS. 6A and 6B are each a schematic cross-sectional view for explaining a rising and lowering movement of the cap unit of the inkjet printing apparatus according to the first embodiment.
Figure 6B:
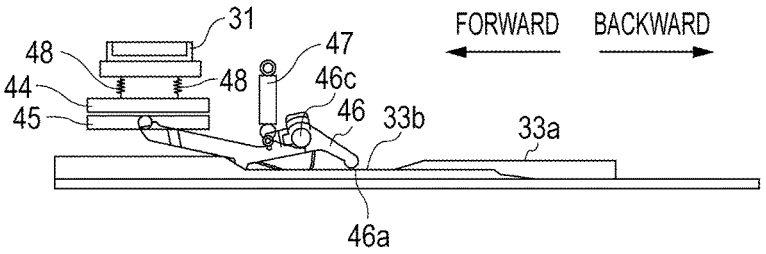

As illustrated in FIG. 5A, when the carriage 21 is in the printing area R, the cap slider 44 is biased by the slider spring 49 toward the printing area R. The position of the cap unit 31 along the main scanning direction in this situation is herein referred to as first position.

Figure 5B:
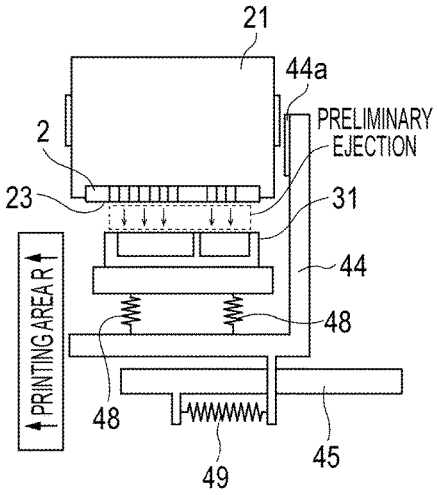

In FIG. 5B, the carriage 21 has entered the recovery area M, but does not abut the abutment portion 44*a*, and the ejection orifice surface 23 of the printhead 2 and the cap unit 31 face each other. In this situation, the first cap 31A can receive ink ejected through the ejection orifice array on the first ejection orifice surface 23A, and the second cap 31B can receive ink ejected through the ejection orifice array on the second ejection orifice surface 23B. The preliminary ejection operation on the printhead 2 is performed at a position illustrated in FIG. 5B. The position of the carriage 21 along the main scanning direction in this situation is herein referred to as preliminary ejection position. Note that when the carriage 21 is at the preliminary ejection position, the cap unit 31 is at the first position along the main scanning direction similarly to the situation illustrated in FIG. 5A.

Figure 5C:
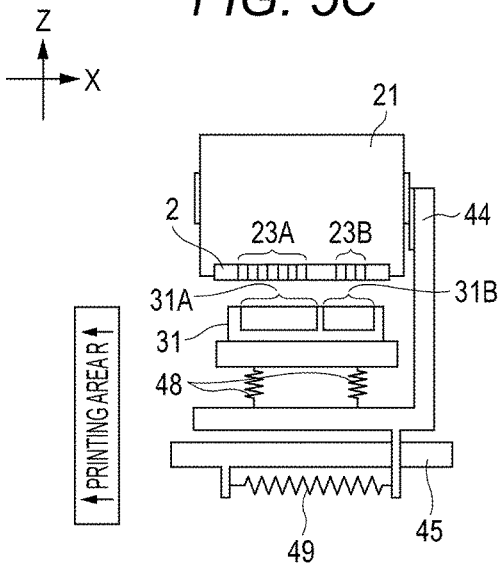

When the carriage 21 moves further into the recovery area M, and abuts the abutment portion 44*a* of the cap slider 44, this movement of the carriage 21 causes the cap slider 44 to also move away from the printing area R. The movement of the cap slider 44 then causes the cap unit 31 to also move into the recovery area M. FIG. 5C illustrates the carriage 21 that has moved with the cap slider 44 to a recovery position. The maintenance unit 30 performs the ink suction operation and the wiping operation on the ejection orifice surface 23 of the printhead 2 when the carriage 21 is at the recovery position along the main scanning direction. The position of the cap unit 31 along the main scanning direction when the carriage 21 is at the recovery position is herein referred to as second position. When the carriage 21 moves toward the printing area R and thus moves apart from the abutment portion 44*a*, biasing force of the slider spring 49 causes the cap slider 44 to move toward the printing area R, thereby returning the cap unit 31 to the first position as illustrated in FIG. 5A.

The preliminary ejection operation is performed by the printhead 2 every predetermined number of scans by the carriage 21 in the printing operation. Thus, as illustrated in FIG. 5B, the configuration in which the preliminary ejection position is nearer to the printing area R than the recovery position illustrated in FIG. 5C at which other operations of the recovery operation are performed can reduce the travel distance of the carriage 21 along the main scanning direction. Thus, the throughput is increased in the preliminary ejection operation and in the printing operation. The cap unit 31 preferably has a sufficient length along the main scanning direction to face the ejection orifice surface 23 in both cases in which the carriage 21 is at the preliminary ejection position and at the recovery position.

The rising and lowering movement of the cap unit 31 will next be described in detail. The cap base 45 is supported so that the cap base 45 can rise and lower with respect to the recovery unit base 36 (see FIG. 3). The cap unit 31 can thus rise and lower in the vertical direction (Z-direction). The recovery unit base 36 rotatably supports a cap arm (arm member) 46 to allow the cap arm 46 to rotate about a rotational center 46*c* supported by the recovery unit base 36 (see FIGS. 6A and 6B). This rotational movement of the cap arm 46 causes the cap unit 31 and the cap base 45 to rise and lower.

As illustrated in FIGS. 6A and 6B, the cap arm 46 is not only connected to the recovery unit base 36, but also connected to the arm spring 47. The cap arm 46 is biased by the arm spring 47 upward in the vertical direction. In other words, the arm spring 47 imparts a rotational moment to the cap arm 46 toward the ejection orifice surface 23 of the printhead 2. This rotational movement of the cap arm 46 is related to the abutment condition between a follower surface arranged on the cap arm 46 and a cam surface of the cam slider 33.

When the carriage 21 reaches the recovery position illustrated in FIG. 5C, the cam slider 33 is connected to a drive source. This enables the cam slider 33 to move reciprocally along the feed direction. This reciprocating movement of the cam slider 33 along the feed direction results in switching of the abutment condition of the follower surface of the cap arm 46 and the cam surface of the cam slider 33. In other word, enabling the cam slider 33 to move reciprocally when the carriage 21 is at the recovery position illustrated in FIG. 5C allows the cap unit 31 to rise and lower in the vertical direction.

FIG. 6B is a schematic cross-sectional view corresponding to FIG. 5C, in which the carriage 21 is at the recovery position along the main scanning direction, and the cap unit 31 is at the second position along the main scanning direction. When the cap unit 31 does not abut the ejection orifice surface 23 as illustrated in FIG. 5C, a follower surface 46*a* of the cap arm 46 abuts a cam surface 33*b* of the cam slider 33. The abutment of the follower surface 46*a* against the cam surface 33*b* causes the portion, to the right of the rotational center 46*c*, of the cap arm 46 to be biased upward in the vertical direction, and the portion, to the left of the rotational center 46*c*, of the cap arm 46 to be biased downward in the vertical direction. In other words, the abutment of the follower surface 46*a* against the cam surface 33*b* produces a rotational moment that counteracts the biasing force of the arm spring 47. Thus, the cap base 45 and the cap unit 31 disposed in a portion to the left of the rotational center 46*c* is biased downward in the vertical direction, and the cap unit 31 and the ejection orifice surface 23 do not abut each other as illustrated in FIG. 5C. The position in the vertical direction that prevents the abutment of the cap unit 31 against the ejection orifice surface 23 as described above is herein referred to as separated position.

Figure 5D:
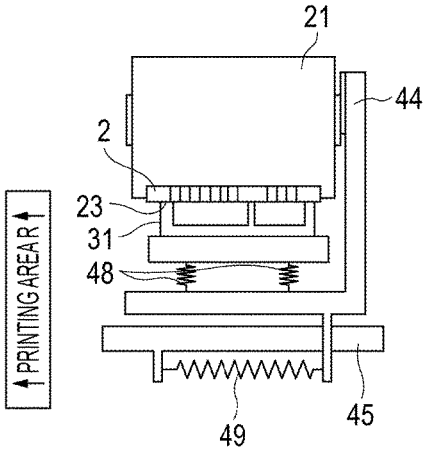

FIG. 6A is a schematic cross-sectional view corresponding to FIG. 5D. In FIG. 6A, the cam slider 33 has moved downstream of the position illustrated in FIG. 6B along the feed direction (Y-direction). When the cap unit 31 abuts the ejection orifice surface 23 as illustrated in FIG. 5D, the follower surface 46*b* of the cap arm 46 abuts the cam surface 33*a* of the cam slider 33. The abutment of the follower surface 46*b* against the cam surface 33*a* stabilizes the bias upward in the vertical direction provided by the arm spring 47, and positions the cap unit 31 in the vertical direction. The position in the vertical direction that allows the cap unit 31 to abut the ejection orifice surface 23 as described above is herein referred to as capping position.

As described above, the movement of the cam slider 33 along the feed direction shifts the position of abutment of the cam slider 33 against the cap arm 46 to cause the cap unit 31 to rise and lower. In other words, abutment of the cam surface 33*b* against the follower surface 46*a* causes the cap unit 31 to move downward in the vertical direction to the separated position, while abutment of the cam surface 33*a* against the follower surface 46*b* causes the cap unit 31 to move upward in the vertical direction to the capping position.

Figure 7:
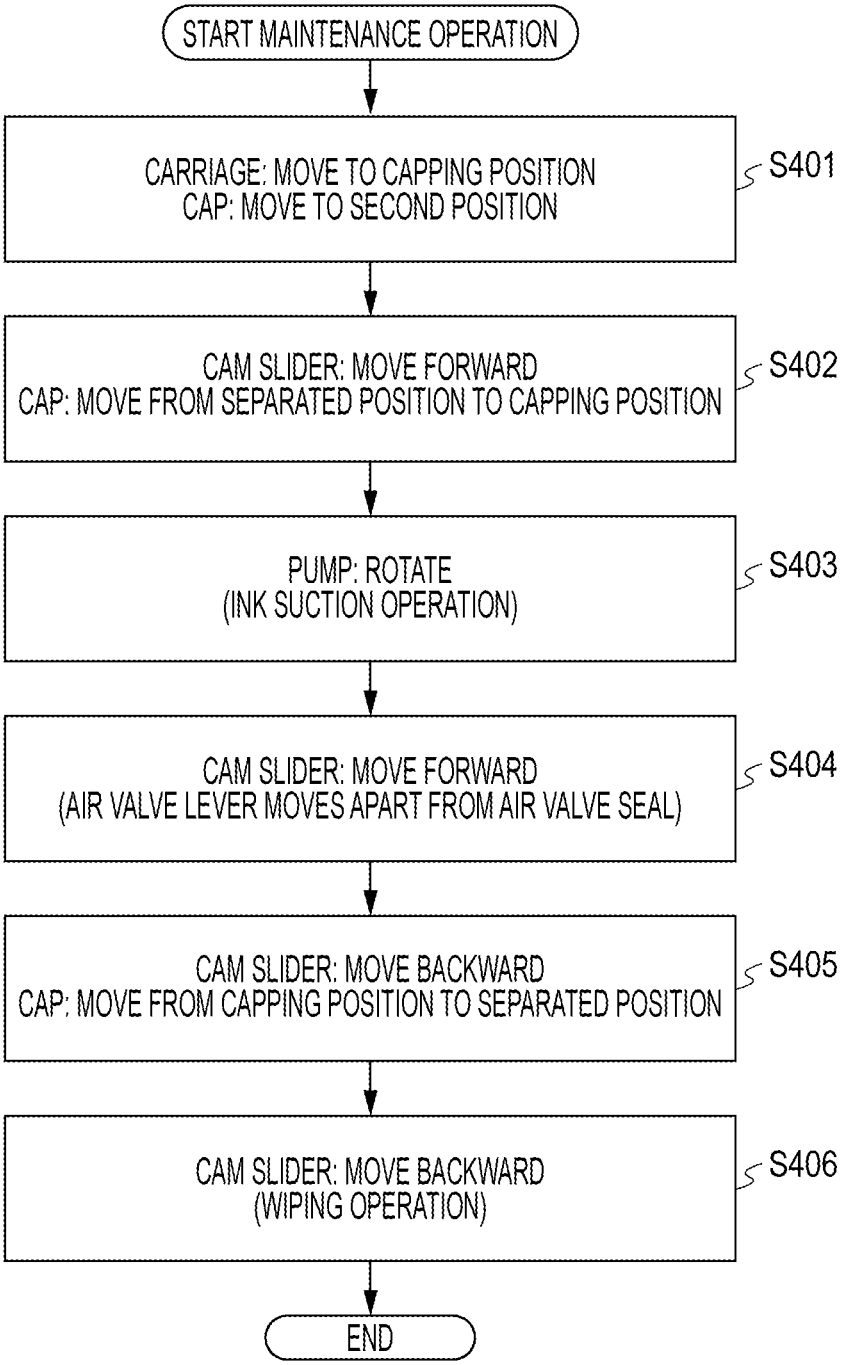
FIG. 7 is a flowchart illustrating a maintenance operation of the inkjet printing apparatus according to the first embodiment.

The recovery operation on the printhead 2 performed by the maintenance unit 30 will next be described with reference to the flowchart of FIG. 7. As used herein, the moving direction of the cam slider 33 downstream along the feed direction (i.e., leftward in FIGS. 6A and 6B) is referred to as forward direction, while the moving direction of the cam slider 33 upstream along the feed direction (i.e., rightward in FIGS. 6A and 6B) is referred to as backward direction.

At step S401, the MPU 201 moves the carriage 21 from the printing area R into the recovery area M to make the carriage 21 abut the abutment portion 44*a* of the cap slider 44. This operation causes the carriage 21 to move to the recovery position, and the cap unit 31 to move to the second position along the main scanning direction. This mechanical abutment of the carriage 21 against the cap slider 44 can provide higher accuracy positioning of the cap unit 31 and the array of wipers 32.

At step S402, MPU 201 moves forward the cam slider 33 to cause the cap unit 31 to rise up to the capping position thereby to cap the ejection orifice surface 23. At step S403, the MPU 201 drives the pump motor 206 to rotate the pump 35 to generate a negative pressure in the cap unit 31 thereby to suck up ink from the ejection orifice arrays (ink suction operation).

When the ink suction operation is completed, the MPU 201 stops the operation of the pump 35. Then, at step S404, the MPU 201 moves the cam slider 33 further forward beyond the position at step S402. This movement of the cam slider 33 causes the air valve lever 37 to move apart from the air valve seal to allow the inside of the cap unit 31 to communicate with the atmosphere. The MPU 201 then causes the pump 35 to rotate again, thereby enabling the ink collected in the cap unit 31 to be sucked up without a need to suck up ink from the ejection orifices.

At step S405, the MPU 201 causes the cam slider 33 to move backward to allow the cap unit 31 to lower to the separated position. At step S406, the MPU 201 causes the array of wipers 32 to operate along the feed direction to wipe off the ink remaining on the ejection orifice surface 23 and other portions. Thus, the recovery operation on the printhead 2 is completed.

As described above, use of the two positions along the main scanning direction, which are the preliminary ejection position and the recovery position, with respect to the carriage 21 in the recovery operation can reduce the travel distance of the carriage 21 along the main scanning direction, and can thus reduce the time required for the recovery operation. In other words, when the carriage 21 is at the recovery position along the main scanning direction, the ink suction operation, in which ink is sucked up from the ejection orifice surface 23 after capping thereof, and the wiping operation, which is performed while the cap unit 31 is positioned spaced apart from the ejection orifice surface 23, can be both performed. In addition, linking the movement of the cap unit 31 along the main scanning direction with the movement of the carriage 21 can provide stabilization of the positioning of the cap unit 31 with respect to the printhead 2 along the main scanning direction.

Other Embodiments

The present disclosure can also be implemented by a process including supplying, via a network or a storage medium, a program for providing at least one function of the first embodiment to a system or apparatus including a computer, and reading and executing the program by at least one processor included in the computer. The present disclosure can also be implemented by a circuit (e.g., application-specific integrated circuit (ASIC)) that provides at least one function of the first embodiment.

Thus, the present disclosure can provide an inkjet printing apparatus capable of reducing the carriage travel distance in a recovery operation performed on the printhead.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-016208, filed Jan. 31, 2017, which is hereby incorporated by reference herein in its entirety.

What is claimed is:

1. An inkjet printing apparatus comprising:

a printhead having an ejection orifice surface on which a plurality of ejection orifices for ejecting ink are arranged, the printhead configured to perform a printing operation in a printing area;

a carriage including the printhead, and movable in a first direction;

a cap for covering the ejection orifice surface; and a wiper configured to wipe the ejection orifice surface;

wherein the cap is movable, by a movement of the carriage, to a first position, and to a second position farther from the printing area than the first position along the first direction, wherein, at the second position along the first direction, the cap can rise and lower to a capping position at which the cap abuts the ejection orifice surface, and to a separated position at which the cap does not abut the ejection orifice surface, and wherein the wiper wipes the ejection orifice surface when the cap is at the second position and at the separated position.

2. The inkjet printing apparatus according to claim 1, further comprising:

a support member configured to support the cap, wherein the carriage abuts the support member to cause the cap to move to the first position and to the second position.

3. The inkjet printing apparatus according to claim 1, wherein the printhead performs a preliminary ejection operation when the cap is at the first position.

4. The inkjet printing apparatus according to claim 1, further comprising:

a drive source for driving the cap to rise and lower; and a cam member configured to operate during being coupled to the drive source, wherein the cam member is not coupled to the drive source when the cap is at the first position, while the cam member is coupled to the drive source when the cap is at the second position.

5. The inkjet printing apparatus according to claim 4, wherein a movement of the cam member coupled to the drive source causes the cap to rise and lower to the capping position and to the separated position.

6. The inkjet printing apparatus according to claim 4, further comprising:

a cap base configured to be able to rise and lower in accordance with a movement of the cam member; and a cap slider configured to support the cap, and be movable along the first direction with respect to the cap base.

7. The inkjet printing apparatus according to claim 6, wherein abutment of the carriage against the cap slider causes the cap to move to the first position and to the second position.

8. The inkjet printing apparatus according to claim 6, further comprising:

an arm member configured to rotate in accordance with the movement of the cam member coupled to the drive source to cause the cap base to rise and lower.

9. The inkjet printing apparatus according to claim 1, further comprising:

a pump coupled to the cap for suction of ink, wherein the pump causes the ink to be sucked from the plurality of ejection orifices when the cap is at the second position and at the capping position.

10. The inkjet printing apparatus according to claim 9, further comprising:

a drive source for driving the cap to rise and lower, wherein the pump is driven by a drive source different from the drive source.

11. An inkjet printing apparatus comprising:

a printhead having an ejection orifice surface on which a plurality of ejection orifices for ejecting ink are arranged, the printhead configured to perform a printing operation in a printing area;

a carriage including the printhead, and movable in a first direction;

a cap for covering the ejection orifice surface;

a drive source for driving the cap to rise and lower; and a cam member configured to operate during being coupled to the drive source, wherein the cap is movable, by a movement of the carriage, to a first position, and to a second position farther from the printing area than the first position along the first direction, wherein, at the second position along the first direction, the cap can rise and lower to a capping position at which the cap abuts the ejection orifice surface, and to a separated position at which the cap does not abut the ejection orifice surface, and wherein when the cap is at the second position, the cam member is coupled to the drive source, and causes the cap to rise and lower to a capping position at which the cap abuts the ejection orifice surface, and to a separated position at which the cap does not abut the ejection orifice surface.

12. The inkjet printing apparatus according to claim 11, wherein the cam member is not coupled to the drive source when the cap is at the first position.

13. The inkjet printing apparatus according to claim 11, further comprising:

a support member configured to support the cap, wherein the carriage abuts the support member to cause the cap to move to the first position and to the second position.

14. The inkjet printing apparatus according to claim 11, wherein the printhead performs a preliminary ejection operation when the cap is at the first position.

15. The inkjet printing apparatus according to claim 11, further comprising:

a cap base configured to be able to rise and lower in accordance with a movement of the cam member; and a cap slider configured to support the cap, and be movable along the first direction with respect to the cap base.

16. The inkjet printing apparatus according to claim 15, wherein abutment of the carriage against the cap slider causes the cap to move to the first position and to the second position.

17. The inkjet printing apparatus according to claim 15, further comprising:

an arm member configured to rotate in accordance with the movement of the cam member coupled to the drive source to cause the cap base to rise and lower.

18. The inkjet printing apparatus according to claim 11, further comprising:

a wiper configured to wipe the ejection orifice surface, wherein the wiper wipes the ejection orifice surface when the cap is at the second position and at the separated position.

19. The inkjet printing apparatus according to claim 11, further comprising:

a pump coupled to the cap for suction of ink, wherein the pump causes the ink to be sucked from the plurality of ejection orifices when the cap is at the second position and at the capping position.

20. The inkjet printing apparatus according to claim 19, wherein the pump is driven by a drive source different from the drive source.

* * * * *